US005131327A

United States Patent [19]

Nagasono et al.

[11] Patent Number: 5,131,327

[45] Date of Patent: Jul. 21, 1992

[54] PLATE WINDING APPARATUS

[75] Inventors: Yasuo Nagasono; Hiroshi Takahashi; Masakazu Kurihara, all of Chiba, Japan

[73] Assignee: Komori Corporation, Tokyo, Japan

[21] Appl. No.: 585,408

[22] Filed: Sep. 20, 1990

[30] Foreign Application Priority Data

Sep. 21, 1989 [JP] Japan ..... 1-109681[U]

[51] Int. Cl.[5] ..... B41F 27/00; B41F 27/12

[52] U.S. Cl. ..... 101/415.1; 101/479

[58] Field of Search ..... 101/415.1, 378, 379, 101/479; 51/364, 367, 368, 370

[56] References Cited

U.S. PATENT DOCUMENTS 3,727,551 4/1973 Kostas et al. ..... 101/415.1

4,862,801 9/1989 Marmin ..... 101/415.1

FOREIGN PATENT DOCUMENTS 96557 6/1983 Japan ..... 101/415.1

*Primary Examiner*—Edgar S. Burr

*Assistant Examiner*—Moshe I. Cohen

*Attorney, Agent, or Firm*—Blakely, Sokoloff, Taylor & Zafman

[57] ABSTRACT

A plate winding apparatus, includes a winding rod which is rotatably received in a first groove, bearing plates, plate holding springs, levers, and plate winding springs. The bearing plates have axial holes each having a diameter larger than that of each of both end portions of the winding rod and pivotally support the winding rod and movably support the winding rod in a direction to increase a distance between the winding rod and a inner wall surface of the first groove. The plate holding springs are fitted in holes formed in a circumferential surface of the winding rod in an axial direction thereof and bias the winding rod against the inner wall surface of the first groove. The levers are fixed on the both end portions of the winding rod. The plate winding springs are arranged between free ends of the levers and plate cylinder end faces and apply pivotal forces in a plate tightening direction after the levers pass over dead centers thereof on the way of pivotal movement of the winding rod in the plate tightening direction.

2 Claims, 4 Drawing Sheets

PLATE WINDING APPARATUS

BACKGROUND OF THE INVENTION

The present invention relates to a plate winding apparatus wherein both end portions of a printing plate wound around the circumferential surface of a plate cylinder in a rotary press are held by a winding rod arranged in a first groove having a circular section in a circumferential portion of the plate cylinder, the winding rod is pivoted to wind both end portions of the plate into the first groove, and the plate is brought into tight contact with the circumferential surface of the plate cylinder.

A conventional plate winding apparatus of this type is disclosed in Japanese Utility Model Laid-Open No. 60-12441. That is, a first groove having a substantially circular section is formed in a circumferential portion of a plate cylinder by its entire length in the axial direction of the plate cylinder. The plate winding apparatus is disposed in the circumferential portion of the plate cylinder. A winding rod having a circular section is pivotally fitted in the first groove so that one end extends from a cylinder end face. A groove extending in the longitudinal direction of the winding rod is formed in its circumferential surface. A compression coil spring is inserted between the cylinder end face and a lever fixed to a portion of the winding rod extending from the plate cylinder end face.

A printing plate to be mounted on this plate cylinder has a rectangular shape made of an aluminum plate or the like, and its leading-side end portion is acutely bent by a plate bending machine or the like. The trailing-side end portion of the plate is bent at an almost right angle.

With the above structure, when a plate is to be wound around the circumferential surface of the plate cylinder, the leading-side bent end portion of the plate is inserted into a first groove between the winding rod and an inner wall surface of the first groove of the plate cylinder, and the plate is wound around the circumferential surface of the plate cylinder. The trailing-side bent end portion of the plate is inserted into the groove of the winding rod. At this time, the winding rod receives a pivotal force by an elastic force of the compression coil spring through a lever in a plate tightening direction. A pivotal limit position of the winding rod is defined by a stopper. In this state, when the winding rod is pivoted, the leading-side bent end portion of the plate is clamped between the winding rod and the inner wall surface of the first groove. The trailing-side bent end portion is wound together with the winding rod since this end portion is inserted into the groove of the winding rod. Therefore, the plate is tightened to be brought into tight contact with the circumferential surface of the plate cylinder. The lever passes over its dead center during pivotal movement. At the end of the pivotal movement, the elastic force of the compression coil spring acts on the plate in the plate tightening direction.

In the conventional plate winding apparatus having the above arrangement, however, since the winding rod is tightly fitted in the first groove of the circular section and cannot be moved within the first groove upon pivotal movement of the winding rod, when a plate thickness is changed, the distance between the inner wall of the first groove and the winding rod which receives the leading-side bent end portion of the plate cannot be adjusted to cope with a change in plate thickness. When the thickness of the plate is large, after the trailing-end bent edge of the plate is brought into contact with the leading-side bent end portion of the plate, the trailing-side bent edge and the trailing-side flat surface of the plate are brought into sliding contact with the leading-side bent portion upon pivotal movement of the winding rod, both the leading- and trailing-side bent portions are undesirably damaged, and the plate cannot be reused, resulting in inconvenience. In addition, since the compression coil spring for biasing the winding rod in the plate tightening direction is arranged on one side of the plate cylinder, a plate tightening force acting on the entire surface of the plate cylinder is locally nonuniform. As a result, misalignment of the plate tends to occur.

SUMMARY OF THE INVENTION

It is an object of the present invention to provide a plate winding apparatus for providing a uniform plate tightening force to improve plate alignment precision.

It is another object of the present invention to provide a plate winding apparatus capable of improving workability in the case of a change in plate thickness, and durability of a plate due to the presence of a predetermined gap between an inner wall surface of a first groove of a plate cylinder and the first groove thereof.

In order to achieve the above objects of the present invention, there is provided a plate winding apparatus, including a winding rod which is rotatably received in a first groove, the first groove having a substantially circular section and formed in a circumferential portion of a plate cylinder so as to extend in an axial direction of the plate cylinder, a plate being wound on the circumferential portion of the plate cylinder, a leading-side bent portion and a trailing-side bent portion of the plate being inserted in a first groove between the winding rod and the first groove, and in a second groove of the winding rod to bring the plate into tight contact with a circumferential surface of the plate cylinder, comprising bearing plates, having axial holes each having a diameter larger than that of each of both end portions of the winding rod, for pivotally supporting the winding rod and movably supporting the winding rod in a direction to increase a distance between the winding rod and the inner wall surface of the first groove, plate holding springs, fitted in holes formed in a circumferential surface of the winding rod in an axial direction thereof, for biasing the winding rod against the inner wall surface of the first groove, levers fixed on the both end portions of the winding rod, and plate winding springs, arranged between free ends of the levers and plate cylinder end faces, for applying pivotal forces in a plate tightening direction after the levers pass over dead centers thereof on the way of pivotal movement of the winding rod in the plate tightening direction.

When a plate is to be mounted on the circumferential surface of the plate cylinder, the leading-side bent end portion of the plate wound around the circumferential surface of the plate cylinder is inserted between the winding rod and the inner wall surface of the first groove of the plate cylinder, and then the trailing-side bent end portion is inserted into the groove of the winding rod. At this time, the winding rod receives a pivotal force by elastic forces of the compression coil springs in the plate tightening direction through levers. In this state, when the winding rod is pivoted, the leading-side bent end portion of the plate is clamped between the winding rod and the inner wall of the first groove of the plate cylinder. At the same time, the trailing-side bent end portion is moved while being inserted into the groove of the winding rod upon pivotal movement of the winding rod. The plate is therefore brought into tight contact with the circumferential surface of the plate. At this time, the levers pass over their dead centers during pivotal movement of the winding rod. At the end of pivotal movement of the winding rod, the elastic forces of the compression coil springs act in the plate tightening direction. At the same time, the winding rod is biased by spring members mounted in the grooves of the winding rod and clamps the leading- and trailing-side bent end portions of the plate between itself and the first groove of the plate cylinder and in the groove of the winding rod.

When the plate thickness is changed, the winding rod is radially moved in holes which support the winding rod to cope with a change in thickness of the plate.

BRIEF DESCRIPTION OF THE DRAWINGS

FIGS. 1 to 6 show an embodiment of a plate winding apparatus according to the present invention, in which:

FIG. 1 is a partially cutaway longitudinal sectional view showing an end portion of a plate cylinder with the plate winding apparatus;

FIG. 2 is a sectional view of the plate winding apparatus along the line II—II in FIG. 1;

FIG. 3 is a sectional view of the plate winding apparatus along the line III—III in FIG. 1;

FIG. 4 is a sectional view of the plate widing apparatus along the line IV—IV in FIG. 1;

FIG. 5 is a sectional view showing a plate tightening state in correspondence with FIG. 2; and FIG. 6 is a sectional view showing a plate tightening state in correspondence with FIG. 4.

DESCRIPTION OF THE PREFERRED EMBODIMENT

Figure 1:
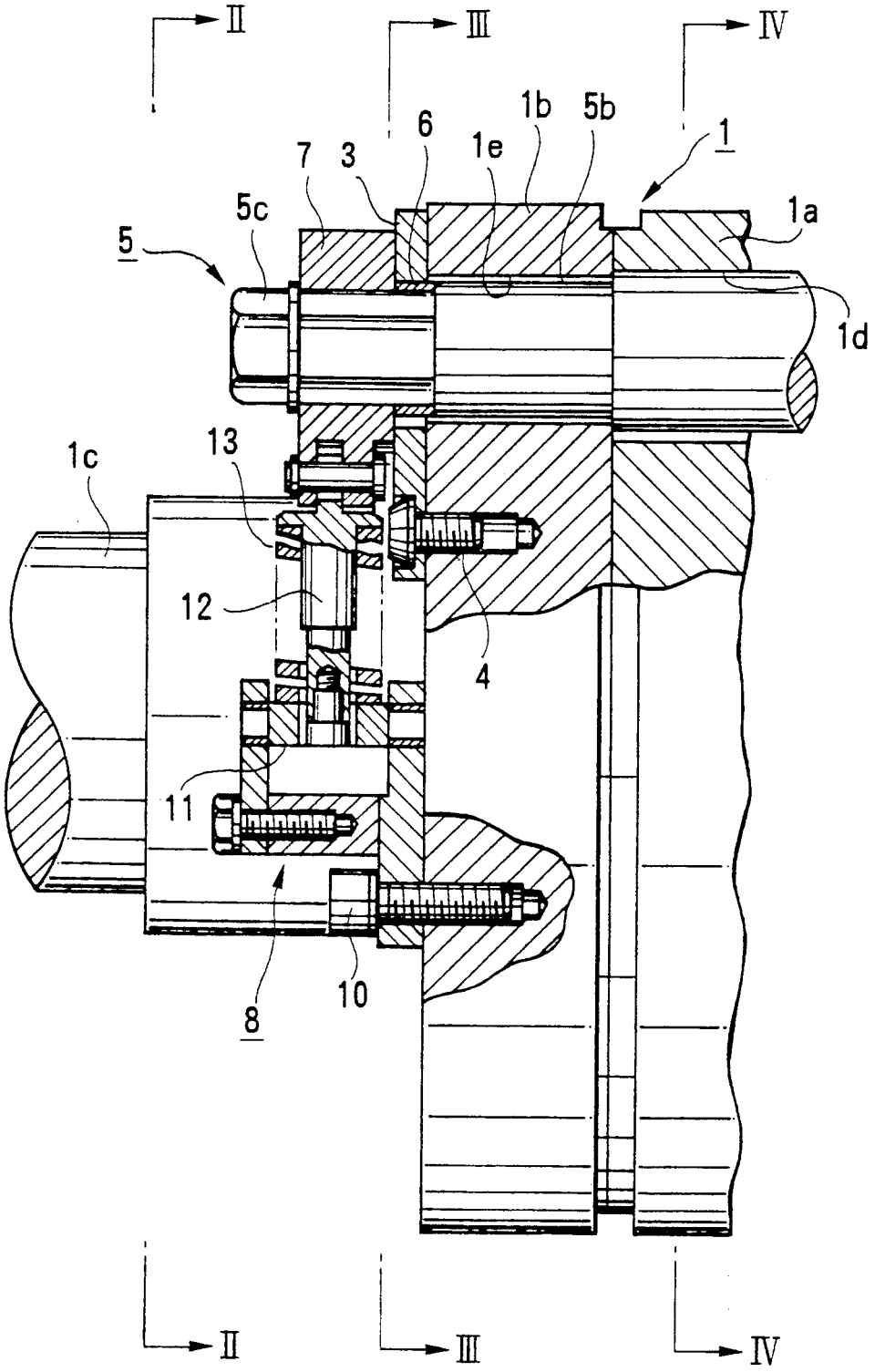

A plate cylinder 1 integrally formed with a cylindrical portion 1*a* and disc bearers 1*b* at both end portions of the cylindrical portion 1*a* is supported so that end shafts 1*c* of the plate cylinder 1 are rotatable about bearings mounted on the right and left frames. A first groove 1*d* and a hole le which are engaged with a winding rod 5 having a substantially circular section (to be described later) are formed in the cylindrical portion 1*a* and the bearers 1*b*. Plates 3 serving as bearing plates each having a rectangular shape are fixed to the end faces of the bearers 1*b* by a plurality of bolts 4, respectively. The winding rod 5 comprises a main body 5*a* fitted within the first groove 1*d* of the cylindrical portion 1*a*, small-diameter shaft portions 5*b* respectively fitted within holes 1*e* of the bearers 1*b* at both ends, and hexagonal head portions 5*c* integrally formed with the small-diameter shaft portions 5*b*. Part of the main body 5*a* is chamfered to form a flat surface 5*d* along the entire length of the main body 5*a*. A second groove 5*e* which receives a trailing-side bent end portion of a plate (to be described later) is formed along the entire length of the main body 5*a*. Annular bushings 6 are mounted on the proximal portions of the hexagonal head portion 5*c* corresponding to the plates 3. The bushings 6 are engaged with axial holes 3*a* of the plates 3. The diameter of the axial hole 3*a* is slightly larger than the diameter of the corresponding bushing 6. The winding rod 5 is pivotal in the axial holes 3*a* and is movable in a direction to increase a distance between the flat surface 5*d* of the winding rod 5 and an inner wall surface 1*f* of the first groove 1*d*. The sectional shape of the first groove 1*d* will be described below. The first groove 1*d* is defined by the inner wall surface 1*f* serving as a flat surface, an inner wall surface 1*g* opposite to the inner wall surface 1*f*, and an arcuated surface 1*h* formed between the flat inner wall surfaces 1*f* and 1*g*.

Levers 7 are split-clamped on the hexagonal head portions 5*c* of the winding rod 5. A pair of right and left brackets 8 and 9 formed as a U-shaped structure by welding and bolting are located at each end of the winding rod 5, i.e., each bearer 1*b*, and are tightened by bolts 10. Of a total of four brackets, i.e., two pairs of right and left brackets 8 and 9, the pair of brackets 8 in-phase in the circumferential direction of the plate cylinder respectively pivotally have spring seats 11. A spring shaft 12 supported on a free end portion of each lever 7 is slidably inserted into an axial hole of a corresponding one of the spring seats 11. A plate winding spring 13 is mounted on each spring shaft 12 between its collar portion and the corresponding spring seat 11. The pair of brackets 9 in-phase in the circumferential direction of the plate cylinder respectively pivotally have spring seats 14. A spring shaft 15 supported on a free end portion of each lever 7 is slidably inserted into an axial hole of a corresponding one of the spring seats 14. A plate winding spring 16 is mounted on each spring shaft 15 between its collar portion and the corresponding spring seat 14. A plurality of spring holes are axially aligned in the main body 5*a* of the winding rod 5. Plate holding springs 18 having elastic forces acting in a direction to separate the winding rod 5 from the arcuated surface 1*h* of the first groove 1*d* through corresponding balls 17 are fitted in the plurality of spring holes.

The leading-side end portion of a plate 19 wound around the circumferential surface of the cylindrical portion 1*a* of the plate cylinder 1 is bent at an acute angle by a bending machine prior to winding. A bent portion 19*a* is inserted between the flat surface 5*d* of the widing rod 5 and the inner wall surface 1*f* of the first groove 1*d*. The trailing-side end portion of the plate 19 is bent at a right angle by a plate bending machine prior to winding, and a bent portion 19*b* is inserted into the second groove 5*e* of the winding rod 5. Reference numeral 20 denotes a stopper which can abut against a free end of each lever 7 to regulate the pivotal range of the lever 7.

Figure 2:
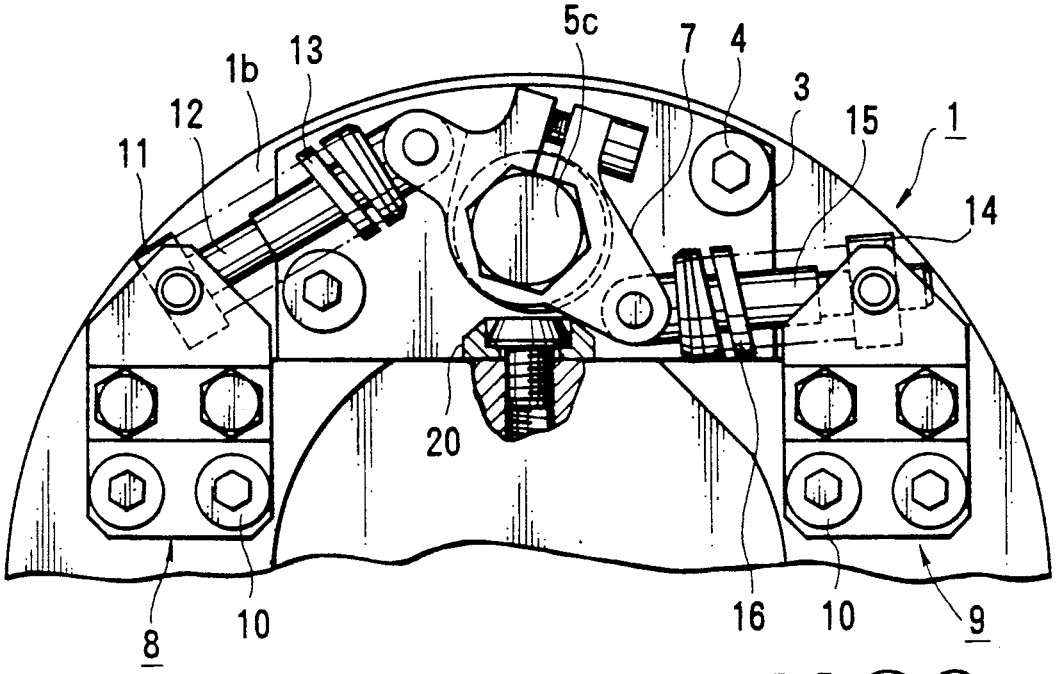
Figure 3:
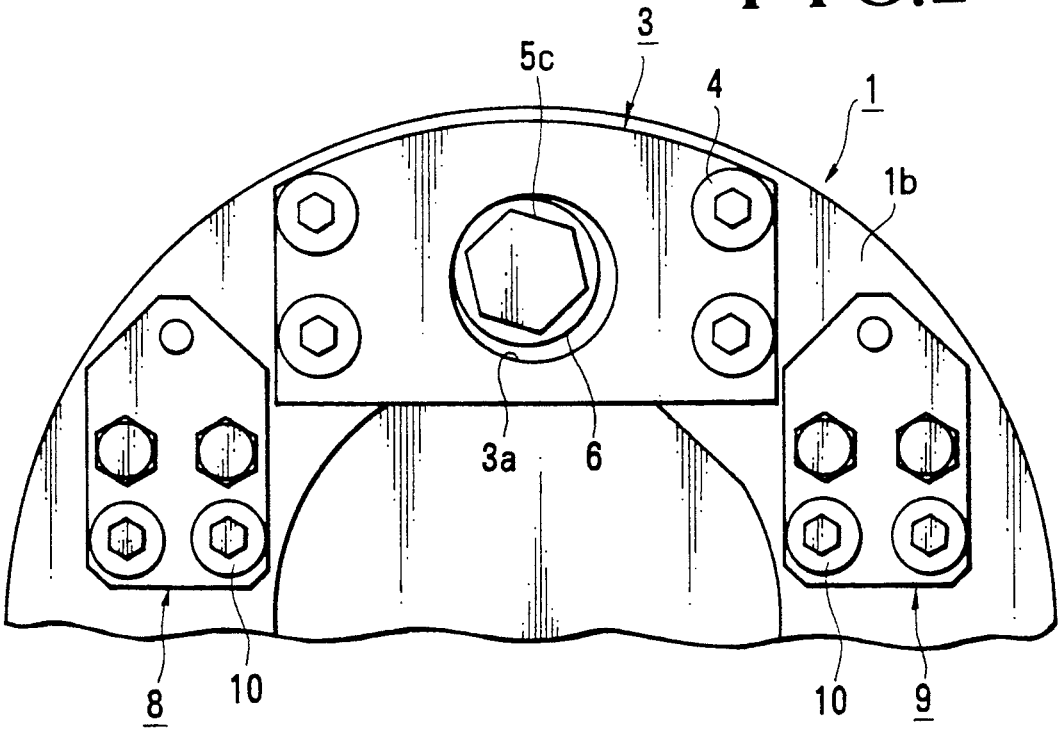
Figure 4:
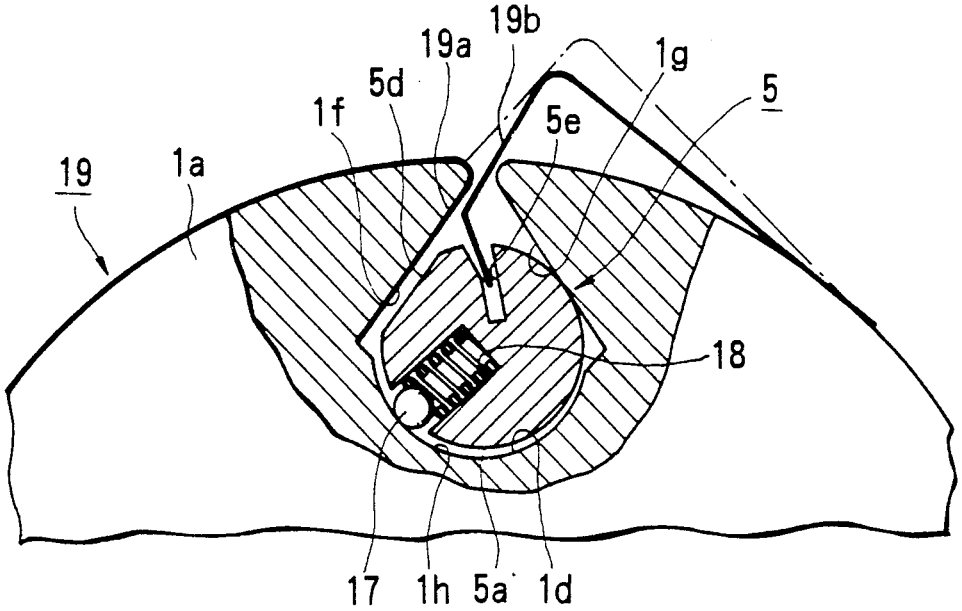
Figure 5:
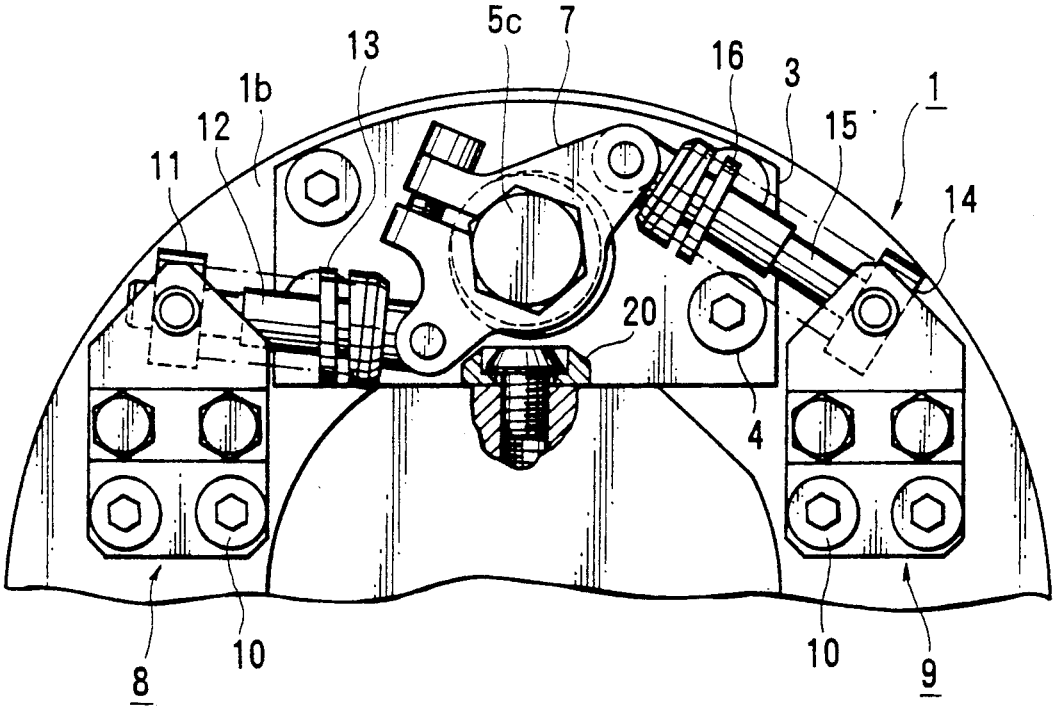
Figure 6:
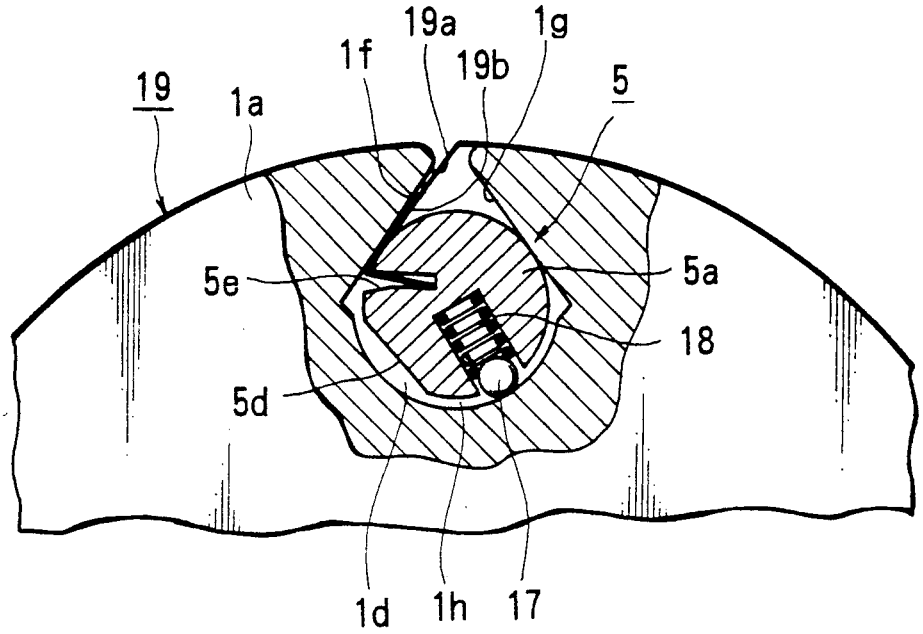

A plate winding operation of the plate winding apparatus having the above arrangement will be described below. The leading-side bent portion 19*a* bent at an acute angle by the plate bending machine beforehand is inserted between the flat surface 5*d* of the winding rod 5 and the inner wall surface 1*f* of the first groove 1*d*, and the plate 19 is wound around the circumferential surface of the cylindrical portion 1*a* of the plate cylinder 1. The trailing-side bent end portion 19*b* bend at a right angle by the plate bending machine beforehand is inserted into the second groove 5*e* of the winding rod 5. This state is shown in FIG. 4. At this time, the levers 7 receive pivotal forces by the four plate winding springs 13 and 16 in a direction to tighten the plate 19. When one free end of each lever 7 abuts against the corresponding stopper 20, its clockwise pivotal movement, i.e., movement in the direction to tighten the plate 19 is limited by the stopper 20. In this state, when a wrench or the like is engaged with the hexagonal head portion 5*c* of the winding rod 5 to pivot the winding rod counterclockwise in FIGS. 2 to 4, the plate 19 is wound such that the leading-side bent portion 19*a* and the trailing-side bent portion 19*b* overlap in the space between the flat surface 5*d* and the inner wall surface 1*f*. In this case, the levers 7 are pivoted while compressing the four plate winding springs 13 and 16. At the end of compression of the plate winding springs 13 and 16, the springs 13 and 16 exceed their dead centers. Thereafter, the springs are extended to apply the pivotal force to the levers 7 in the same direction as that given before they reach the dead centers. As shown in FIG. 5, when the tensions of the plate winding springs 13 and 16 are balanced with the tension of the plate 19, pivotal movement of the levers 7 is stopped, thereby completing the winding operation of the plate 19, as shown in FIG. 6. At this time, as shown in FIG. 6, the winding rod 5 is separated from the arcuated surface 1*h* by the elastic forces of the plate holding springs 18 to hold the bent portions 19*a* and 19*b* in the space defined by the inner wall surface 1*f*. Since the winding rod 5 applies the pivotal force to the plate by the elastic forces of the plate winding springs 13 and 16 in the plate tightening direction, the plate 19 is not loosened. In addition, the winding rod 5 receives pivotal forces by the four plate winding springs 13 and 16, i.e., a leading-side spring, a trailing-side spring, a driving-side spring, and an operation-side spring in the direction to tighten the plate. Therefore, a uniform plate tightening force acts on the respective portions of the plate 19. Since the diameter of the axial hole 3*a* of each plate 3 is larger than the diameter of the bushing 6, when the thickness of the plate 19 is changed, the winding rod 5 can be moved in correspondence with a change in plate thickness. In the initial period of plate winding shown in FIG. 4, since a predetermined space is assured between the flat surface 5*d* of the winding rod 5 and the inner wall surface 1*f* of the first groove 1*d*, the trailing-side bent edge of the plate 19 does not abut against the leading-side bent portion 19*a*, or both bent portions 19*a* and 19*b* are not brought into sliding contact with each other with a large force.

In the plate winding apparatus according to the present invention, as has been described above, both the end portions of the winding rod are pivotally supported by the adjustable bearing plates having the axial holes slightly larger than the diameter of each of the both end portions of the winding rod and at the same time supported to be movable in a direction to increase a distance between the winding rod and the inner wall surface of the first groove. The spring members for biasing the winding rod against the inner wall surface of the first groove of the plate cylinder are mounted in the spring holes formed in the circumferential surface of the winding rod. The spring members are arranged between the free ends of the levers fixed on the extended portions of the both ends of the winding rod and the plate cylinder end faces to apply pivotal forces in the plate tightening direction when the levers pass over their dead centers during pivotal movement of the winding rod in the plate tightening direction. The winding rod receives the pivotal force by the elastic forces of the winding spring members in the plate tightening direction through the levers. Therefore, the plate is not loosened. The winding rod receives the pivotal forces by the four spring members, i.e., the leading-side spring, the trailing-side spring, the driving-side spring, and the operation-side spring. Therefore, a uniform plate tightening force acts on each portion of the plate, and plate alignment precision can be improved. When the thickness of the plate is changed, the winding rod is moved within the axial hole having the diameter larger than that of the winding rod to easily cope with a change in thickness of the plate, thereby improving workability. At the initial period of plate winding, a predetermined space is formed between the flat surface of the winding rod and the inner wall surface of the first groove of the plate cylinder. The trailing-side bent portion of the plate is not brought into contact with its leading-side bent portion to damage the plate. Both the bent portions are not brought into sliding contact with each other with a strong force. Therefore, durability of the plate can be improved.

What is claimed is:

1. A plate winding apparatus, including a winding rod which is rotatably received in a first groove, said first groove having a substantially circular section and formed in a circumferential portion of a plate cylinder so as to extend in an axial direction of said plate cylinder, a plate being wound on the circumferential portion of said plate cylinder, a leading-side bent portion and a trailing-side bent portion of said plate being inserted in a first groove between said winding rod and said first groove, and in a second groove of said winding rod to bring said plate into tight contact with a circumferential surface of said plate cylinder, comprising:

bearing plates, having axial holes each having a diameter larger than that of each of both end portions of said winding rod, for pivotally supporting said winding rod and movably supporting said winding rod in a direction to increase a distance between said winding rod and said inner wall surface of said first groove;

plate holding springs, fitted in holes formed in a circumferential surface of said winding rod in an axial direction thereof, for biasing said winding rod against said inner wall surface of said first groove;

a pair of levers fixed on said both end portions of said winding rod; and plate winding springs, arranged between free ends of said levers and plate cylinder end faces, having a leading-side spring, a trailing-side spring, a driving-side spring, and an operation-side spring, for applying pivotal forces in a plate tightening direction after said levers pass over dead centers thereof on the way of pivotal movement of said winding rod in the plate tightening direction.

2. An apparatus according to claim 1, wherein said winding rod includes a flat surface which defines a predetermined space with said inner wall surface.

* * * * *